US005819755A

United States Patent [19]

Wang

[11] Patent Number: 5,819,755

[45] Date of Patent: Oct. 13, 1998

[54] DRYING DEVICE FOR A CIGARETTE STICK

[76] Inventor: Tzuoh-Yan Wang, No. 3, Alley 26, Lane 44, Ho-Hsing Rd., Wen-Shan Dist., Taipei City, Taiwan

[21] Appl. No.: 815,062

[22] Filed: Mar. 11, 1997

[51] Int. Cl.[6] ..... A24B 15/00

[52] U.S. Cl. ..... 131/329; 131/328; 131/175; 131/193; 131/194

[58] Field of Search ..... 131/329, 328, 131/219, 330, 175, 193, 194; 222/146

[56] References Cited

U.S. PATENT DOCUMENTS 4,262,820 4/1981 Flint ..... 222/146

4,819,666 4/1989 Turver ..... 131/175

*Primary Examiner*—John G. Weiss
*Assistant Examiner*—Charles W. Anderson
*Attorney, Agent, or Firm*—Ladas & Parry

[57] ABSTRACT

A drying device for a cigarette stick includes a hollow cylinder body and a heat applicator. The cylinder body has an open top portion, a closed bottom portion, and an inner wall surface which confines a stick receiving space that is adapted to receive the cigarette stick therein. The heat applicator is provided on the cylinder body for generating heat along the inner wall surface of the cylinder body to heat the stick receiving space. The stale taste of the cigarette stick can be reduced, and the freshness of the cigarette stick can be recovered when the cigarette stick is heated in the stick receiving space of the cylinder body.

7 Claims, 4 Drawing Sheets

DRYING DEVICE FOR A CIGARETTE STICK

BACKGROUND OF THE INVENTION

1. Field of the Invention

The invention relates to smoking articles, more particularly to a drying device for a cigarette stick.

2. Description of the Related Art

A cigarette pack is usually provided with an aluminum foil to help maintain freshness of cigarette sticks in the pack. However, once the cigarette pack is opened, the cigarette sticks easily become stale, especially in humid environments. It is thus desirable to provide a smoking article which can be used to dry a cigarette stick before lighting the same in order to reduce the stale taste and recover the freshness of the cigarette stick.

SUMMARY OF THE INVENTION

Therefore, the object of the present invention is to provide a drying device for a cigarette stick for drying the latter before lighting the same so as to reduce the stale taste and recover the freshness of the cigarette stick.

According to the present invention, a drying device for a cigarette stick comprises:

a hollow cylinder body having an open top portion, a closed bottom portion, and an inner wall surface which confines a stick receiving space that is adapted to receive the cigarette stick therein; and heat applicator means provided on the cylinder body for generating heat along the inner wall surface of the cylinder body to heat the stick receiving space.

The stale taste of the cigarette stick can be reduced, and the freshness of the cigarette stick can be recovered when the cigarette stick is heated in the stick receiving space of the cylinder body by the heat applicator means.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

According to the present invention, a cigarette stick is heated in a drying device so that the stale taste of the cigarette stick can be reduced, and the freshness of the cigarette stick can be recovered.

Figure 1:
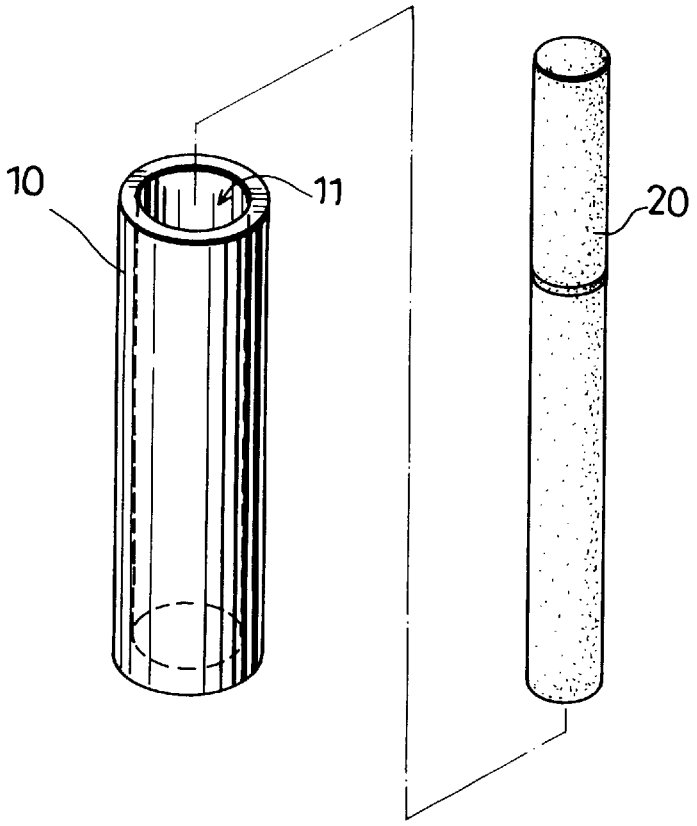
FIG. 1 illustrates the first preferred embodiment of a drying device according to the present invention.

Referring to FIG. 1, the first preferred embodiment of a drying device according to the present invention is shown to comprise a hollow cylinder body 10 having an open top portion, a closed bottom portion, and an inner wall surface which confines a stick receiving space 11 that is adapted to receive the cigarette stick 20 therein. The cylinder body 10 is formed as a molded article by using a composition which contains an infrared radiating inorganic composite or ceramic material. As such, the cylinder body 10 is capable of inherently generating infrared radiation along its inner wall surface for heating the stick receiving space 11. One example of the inorganic composite material capable of infrared radiation is disclosed in R.O.C. Patent Publication No. 167674. The composite material disclosed therein comprises platinum, alumina, titanium and silica, and can be made into fibers. Since infrared radiating inorganic composite or ceramic materials are known in the art, it is not intended to detail the same herein.

Figure 2:
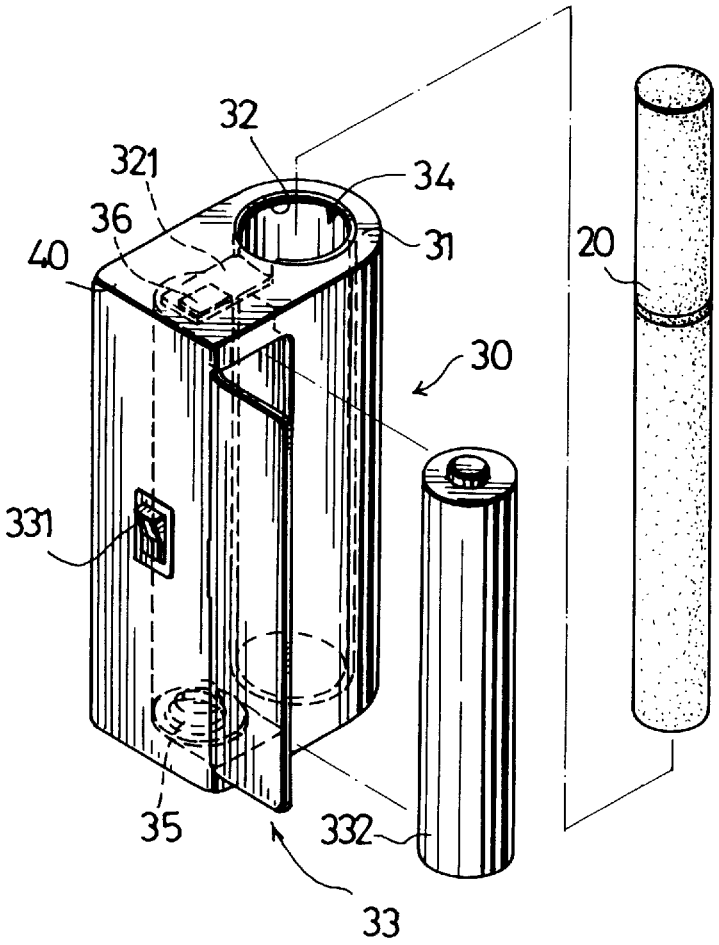
FIG. 2 illustrates a second preferred embodiment of a drying device according to the present invention.

Referring to FIG. 2, the second preferred embodiment of a drying device 30 according to the present invention is shown to comprise a hollow cylinder body 31 having an open top portion, a closed bottom portion, and an inner wall surface which confines a stick receiving space 34 that is adapted to receive the cigarette stick 20 therein. The cylinder body 31 is made of a heat insulating material, such as plastic. The drying device 30 further comprises a heat applicator unit provided on the cylinder body 31 for generating heat along the inner wall surface of the cylinder body 31 to heat the stick receiving space 34. In this embodiment, the heat applicator unit comprises a resistive metal lining 32 provided on the inner wall surface of the cylinder body 31. A cell unit 33 is provided on one side of the cylinder body 31. The metal lining 32 is formed with an extension 321 which extends out of the cylinder body 31 for electrical connection with the cell unit 33. The cell unit 33 is operable so as to supply electric current to the metal lining 32 in order to enable the latter to dissipate heat to the stick receiving space 34. In this embodiment, the cell unit 33 comprises a cell housing 40 formed on one side of the cylinder body 31 and adapted to receive a battery cell 332 therein, and a switch 331 mounted on the cell housing 40 and operable so as to connect electrically the battery cell 332 and the metal lining 32 via positive and negative contacts 36, 35 on the cell housing 40.

Figure 3:
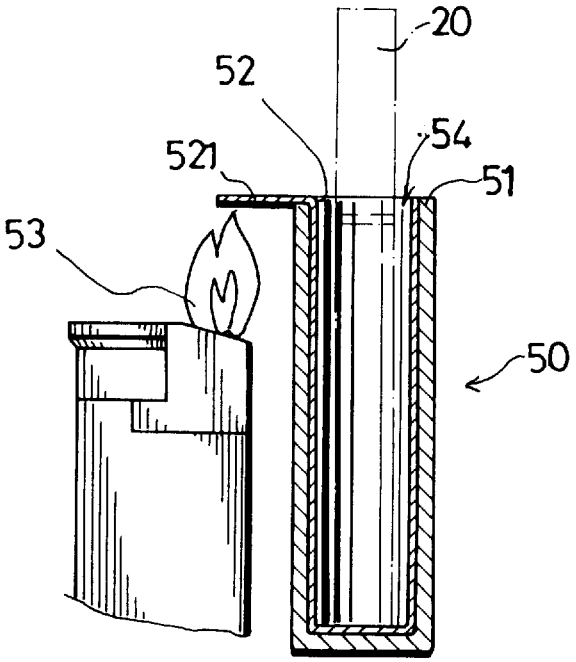
FIG. 3 is a sectional view of a third preferred embodiment of the present invention.

Referring to FIG. 3, the third preferred embodiment of a drying device 50 according to the present invention is shown to comprise a hollow cylinder body 51 having an open top portion, a closed bottom portion, and an inner wall surface which confines a stick receiving space 54 that is adapted to receive the cigarette stick 20 therein. The cylinder body 51 is made of a heat insulating material, such as plastic. The drying device 50 further comprises a heat applicator unit provided on the cylinder body 51 for generating heat along the inner wall surface of the cylinder body 51 to heat the stick receiving space 54. In this embodiment, the heat applicator unit comprises a metal lining 52 provided on the inner wall surface of the cylinder body 51. The metal lining 52 is formed with a radial extension 521 which extends out of the cylinder body 51 to permit application of heat thereto by a flame source, such as a gas lighter 53.

Figure 4:
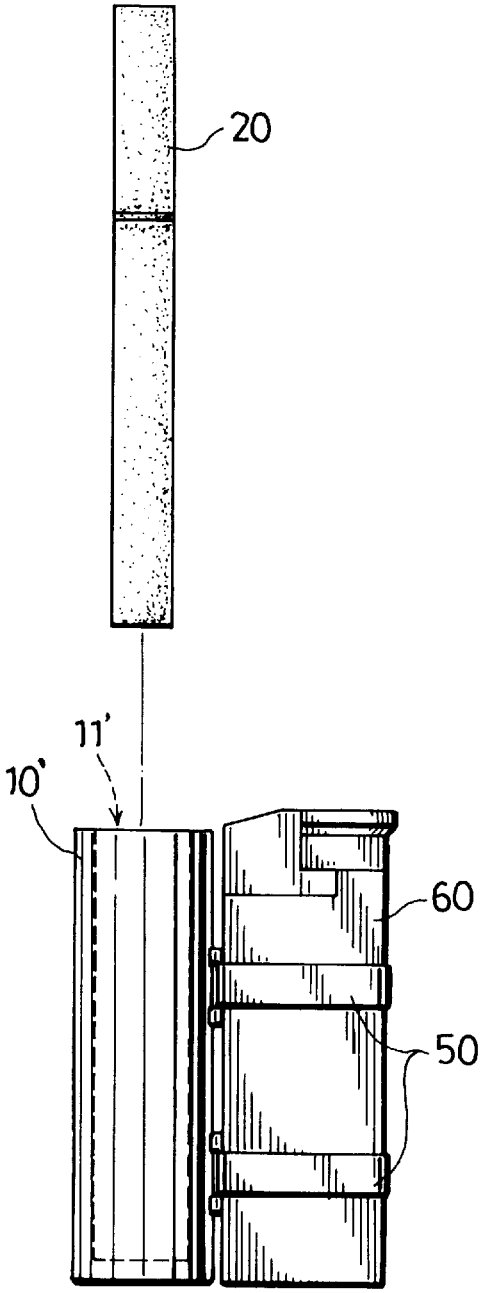
FIG. 4 is a schematic view of a fourth preferred embodiment of a drying device according to the present invention.

FIG. 4 illustrates the fourth preferred embodiment of a drying device according to the present invention. The drying device comprises a cylinder body 10' which confines a stick receiving space 11' and which is similar to the cylinder body 10 described in FIG. 1. However, the drying device of this embodiment further comprises a gas lighter 60 and a connector unit 50 for mounting the gas lighter 60 on one side of the cylinder body 10' to facilitate carrying of the drying device.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A drying device for a cigarette stick, comprising:

a hollow cylinder body having an open top portion, a closed bottom portion, and an inner wall surface which confines a stick receiving space that is adapted to receive the cigarette stick therein; and heat applicator means provided on said cylinder body for generating heat along said inner wall surface of said cylinder body to heat said stick receiving space;

whereby, stale taste of the cigarette stick can be reduced, and freshness of the cigarette stick can be recovered when the cigarette stick is heated in said stick receiving space of said cylinder body by said heat applicator means.

2. The drying device of claim 1, wherein said cylinder body is said heat applicator means, and said cylinder body is formed as a molded article which comprises an infrared radiating inorganic composite material.

3. The drying device of claim 1, wherein said cylinder body is made of a heat insulating material, and said heat applicator means comprises a metal lining provided on said inner wall surface of said cylinder body.

4. The drying device of claim 3, wherein said metal lining is a resistive layer, and said heat applicator means further comprises cell means provided on one side of said cylinder body and connected electrically to said metal lining, said cell means being operable so as to supply electric current to said metal lining in order to enable said metal lining to dissipate heat to said stick receiving space.

5. The drying device of claim 4, wherein said cell means comprises:

a cell housing formed on one side of said cylinder body and adapted to receive a battery cell therein; and a switch mounted on said cell housing and operable so as to connect electrically the battery cell and said metal lining.

6. The drying device of claim 3, wherein said metal lining is formed with a radial extension which extends out of said cylinder body to permit application of heat thereto by a flame source.

7. The drying device of claim 1, further comprising a gas lighter and connecting means for mounting said gas lighter on one side of said cylinder body.

* * * * *